US010323857B2

(12) United States Patent
Cantolino et al.

(10) Patent No.: US 10,323,857 B2
(45) Date of Patent: Jun. 18, 2019

(54) COUPLING HARNESS FOR HVAC MINI-SPLIT SYSTEM

(71) Applicant: RectorSeal, LLC, Houston, TX (US)

(72) Inventors: Christopher Cantolino, Bradenton, FL (US); Mark Oudshoorn, Parrish, FL (US); Robert Dean Sells, Palmetto, FL (US)

(73) Assignee: RectorSeal, LLC, Houston, TX (US)

( * ) Notice: Subject to any disclaimer, the term of this patent is extended or adjusted under 35 U.S.C. 154(b) by 17 days.

(21) Appl. No.: 15/416,436

(22) Filed: Jan. 26, 2017

(65) Prior Publication Data

US 2017/0254552 A1 Sep. 7, 2017

Related U.S. Application Data

(63) Continuation of application No. 14/715,068, filed on May 18, 2015, which is a continuation of application No. 12/806,977, filed on Aug. 25, 2010, now Pat. No. 9,038,405.

(51) Int. Cl.

| | |
|---|---|
| ***F25B 49/00*** | (2006.01) |
| ***G06F 19/00*** | (2018.01) |
| ***F24F 13/22*** | (2006.01) |
| ***F25D 21/14*** | (2006.01) |
| ***F24F 11/30*** | (2018.01) |
| *F24F 110/00* | (2018.01) |
| *F24F 140/30* | (2018.01) |
| *F24F 11/83* | (2018.01) |

(52) U.S. Cl.

CPC ..... *F24F 13/222* (2013.01); *F24F 11/30* (2018.01); *F25D 21/14* (2013.01); *F24F 11/83* (2018.01); *F24F 2110/00* (2018.01); *F24F 2140/30* (2018.01); *F25B 2600/0251* (2013.01)

(58) Field of Classification Search

CPC .... F25B 13/00; F25B 2700/04; F25B 13/222; F25B 11/008; F25B 2011/0054; F25B 11/001; F25B 2600/0251; F25D 2700/12; F25D 21/006; F25D 21/14; B60H 1/3207

USPC ..... 62/150, 272, 226, 228.1; 73/307, 304 R; 700/276; 340/636.1

See application file for complete search history.

(56) References Cited

U.S. PATENT DOCUMENTS 4,165,509 A * 8/1979 Betts ..... G01F 23/243 340/605
4,705,212 A * 11/1987 Miller ..... F16T 1/00 137/171
5,522,229 A * 6/1996 Stuchlik, III ..... E03C 1/28 340/620

(Continued)

*Primary Examiner* — Frantz F Jules
*Assistant Examiner* — Meraj A Shaikh
(74) *Attorney, Agent, or Firm* — Marc L. Delflache; Jones Delflache LLP

(57) ABSTRACT

A coupling harness useful with a HVAC mini-split system includes a first interface connected to a thermistor, a second interface connected to a condensate overflow sensor and a control device interface connected to a HVAC electronic control device. The first and second interfaces can notify the control device interface of the existence of an alarm condition of the thermistor and condensate overflow sensor, respectively. The control device interface can actuate the HVAC electronic control device in response to such notifications that an alarm condition exists for the thermistor or condensate overflow sensor.

1 Claim, 4 Drawing Sheets

(56) References Cited

U.S. PATENT DOCUMENTS

| | | | | |
|---|---|---|---|---|
| 5,534,849 | A * | 7/1996 | McDonald | G08B 13/08 340/511 |
| 6,084,373 | A * | 7/2000 | Goldenberg | B25J 9/08 318/568.11 |
| 6,104,157 | A * | 8/2000 | Kramer | F02N 11/0851 318/430 |
| 6,239,709 | B1 * | 5/2001 | Dykstra | G01F 23/247 340/450 |
| 7,129,832 | B2 * | 10/2006 | Sabatino | G01F 23/0069 116/109 |
| 7,744,395 | B1 * | 6/2010 | Cantolino | H01R 24/84 439/279 |
| 8,154,313 | B1 * | 4/2012 | Cantolino | F24F 11/30 324/750.01 |
| 2007/0001019 | A1 * | 1/2007 | Sinstedten | F16T 1/12 236/93 R |
| 2007/0039345 | A1 * | 2/2007 | Forsberg | E03B 3/28 62/285 |
| 2007/0127546 | A1 * | 6/2007 | Gul | G01K 3/06 374/147 |
| 2007/0271938 | A1 * | 11/2007 | Shaffer | F25B 27/00 62/228.1 |
| 2010/0031680 | A1 * | 2/2010 | Eisenhour | B60H 1/3207 62/176.1 |
| 2010/0082161 | A1 * | 4/2010 | Patch | F24F 11/0001 700/276 |

* cited by examiner

COUPLING HARNESS FOR HVAC MINI-SPLIT SYSTEM

CROSS REFERENCE TO RELATED APPLICATIONS

This Application is a continuation application of and claims priority to U.S. patent application Ser. No. 14/715,068 filed on May 18, 2015 and entitled "Coupling Harness For HVAC Mini-Split System," which is a continuation application and claims priority to U.S. patent application Ser. No. 12/806,977 filed on Aug. 25, 2010 and entitled "Solid State Control System," both of which are hereby incorporated by reference herein in their entirety.

FIELD OF THE DISCLOSURE

The present disclosure relates generally to HVAC systems, and more particularly, to mini-split HVAC systems.

BACKGROUND

Air handling systems such as air conditioning systems typically have a condensate drain pan to collect condensate.

Often removal of the condensate requires pumping the condensate from the condensation drain pan. Commonly, a drain pan system includes a sensor placed in the drain pan to measure the level of the condensation therein. When the condensate level reaches a predetermined level, the sensor generates a signal sent to a sensor switching circuit to activate the pump or stop operation of the compressor.

HVAC systems know as mini-split systems present a particularly troublesome challenge. Mini-split systems comprise of two basic units—a compressor and multiple air handlers. The air handler is typically mounted on the wall in the space to be cooled. These air handlers are designed to be compact resulting in limited space for an overflow switch and condensate sensor. Specifically, systems use refrigerant lines together power and control wiring to connect the outdoor compressor to the individual indoor air handlers. The technology, developed in the 1950s, is called split-ductless or mini-split and is the primary method for conditioning spaces within a home or commercial building in countries around the world. Mini-split systems allow each space with an indoor air-handler unit to be controlled independently from other rooms, thus providing individualized comfort control within a home.

In such mini-split systems, the compressor is connected to existing house voltage and supplies voltage to the air handlers.

In addition, a communications link is used to coordinate the operation of the two basic units. As a result, any electronics that would utilize the power supply has the potential of disrupting the communication link. Thus, any effort to provide a condensate removal system would require an electrically isolated battery powered system.

In order to shut down the highly integrated electromechanical mini-split system, a condensate control system can be tapped into a commonly found thermistor used to measure the evaporator temperature forming part of mini-split control loop. As designed, if the thermistor is broken or indicates a bad reading the compressor is shut down. This thermistor can be used to open the circuit when excess condensate is sensed in the condensate drain pan to shut down the compressor.

The present invention employs a solid state relay or switch to control the thermistor without intruding or compromising the integrity of the power supply or communication link of existing mini-split systems.

BRIEF SUMMARY OF THE DISCLOSURE

The present invention relates to a control system to selectively control the operation of the compressor of a mini-split air conditioning system that includes a compressor and at least one remote air handler.

The present invention is a method of providing alarm signals to a HVAC mini-split system having a thermistor, a condensate overflow sensor and a HVAC electronic control device. The method includes removably engaging a unitary, releasable, self-contained, alarm coupling harness (having first, second and third electrically-coupled interfaces) with the HVAC mini-split system by electrically connecting the first interface with the thermistor, electrically connecting the second interface with the condensate overflow sensor and electrically connecting the third interface with the HVAC electronic control device. At least one among the first and second interfaces directs a signal to the third interface when an alarm condition exists in the thermistor and/or condensate overflow sensor, respectively. In response to a signal received from either the first or second interfaces, the third interface notifying the HVAC electronic control device that an alarm condition exists.

The control system comprises a condensate sensor disposed to sense when condensate within the condensate drain pan reaches a predetermined level and a control device operatively coupled between the condensate sensor the control sensor and the air handler electronic system to turn off the compressor when the predetermined operating conditions exists.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF PREFERRED EMBODIMENTS

Figure 1:
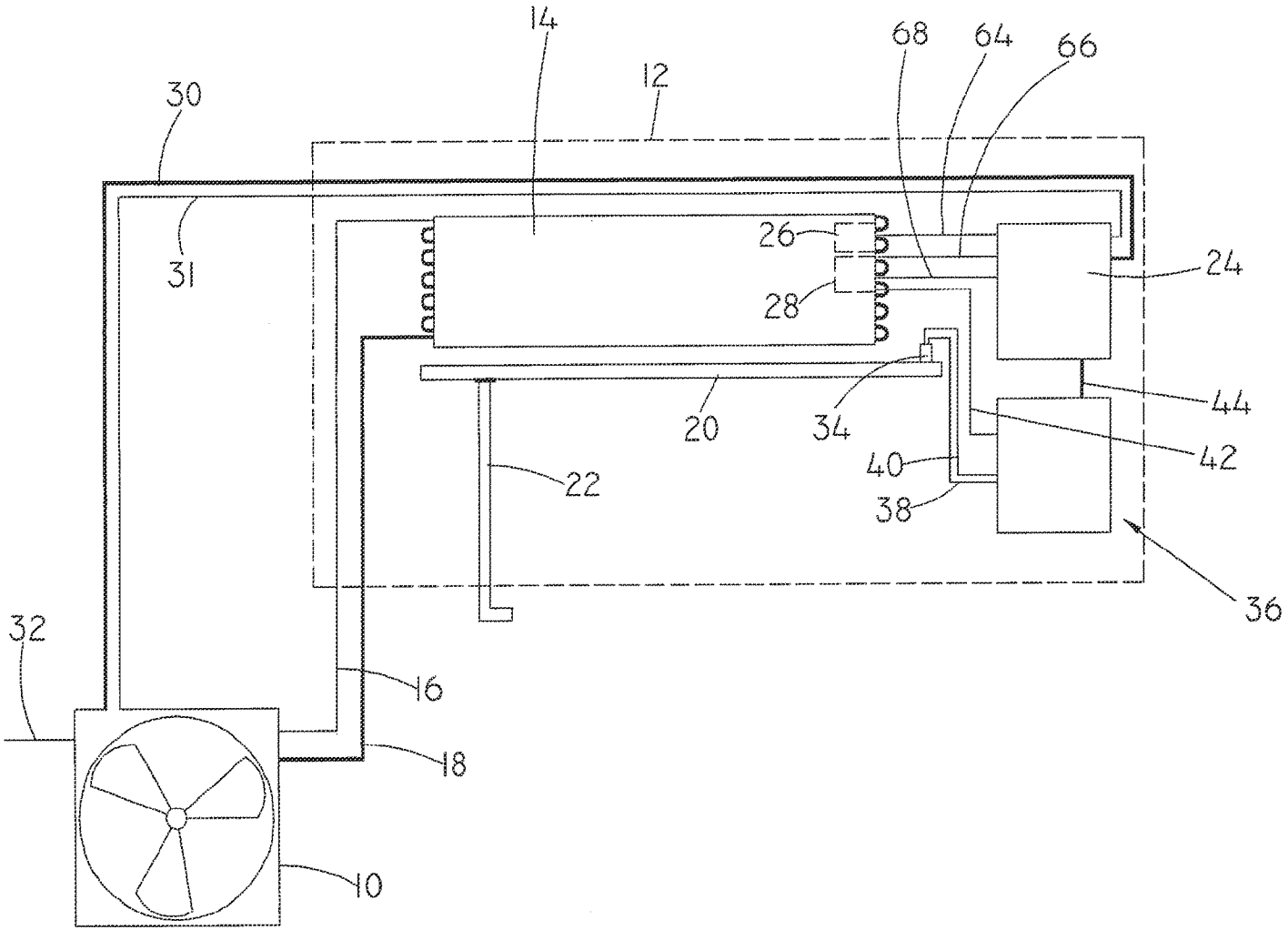
FIG. 1 is a block diagram of the control system of the present invention in combination with a mini-split air conditioning system.

The present invention relates to a control system to selectively control the operation of the compressor of a mini-split air conditioning system that includes a compressor and at least one remote air handler shown as 10 and 12 respectively in FIG. 1.

Figure 2:
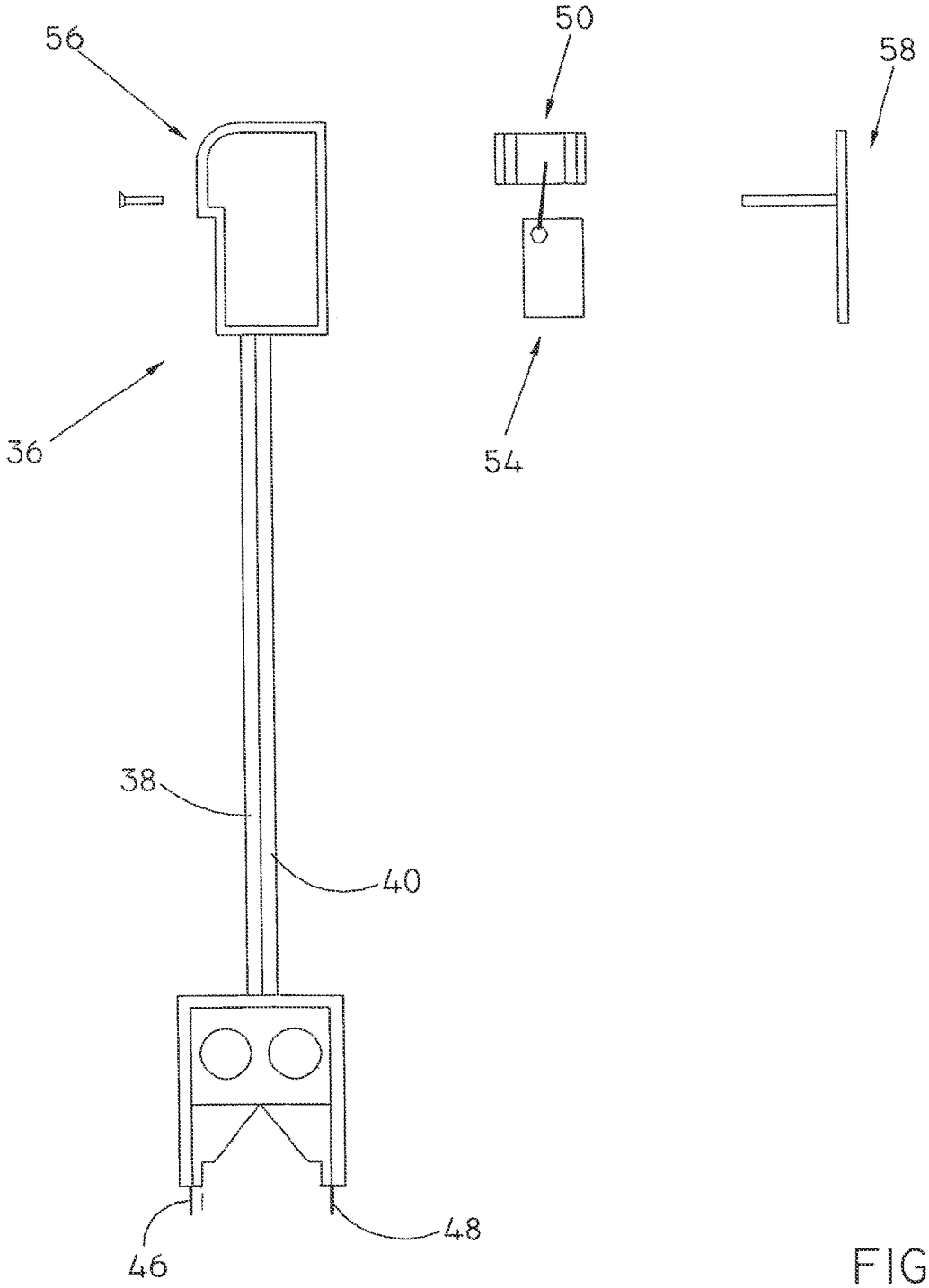
FIG. 2 is an exploded view of the control system of the present invention.

As shown in FIG. 2, the air handler 12 includes an evaporator 14 coupled in closed-loop fluid communication with the compressor 10 by refrigerant lines or conduits 16 and 18, a condensate drain pan 20 disposed to receive or capture condensate from the evaporator 14 and a condensate drain 22 to direct or carry condensate from the condensate drain pan 14 to a collection or run-off site (not shown). The air handler 12 further includes an air handler electronics system 24 coupled to multiple or redundant control sensors or thermistors 26 and 28 disposed in heat exchange relationship relative to the evaporator 14. The control sensors or thermistors 26 and 28 are coupled to the air handler electronics system 24 and the control device 36 as described hereinafter and ultimately to the compressor 10 by air handler power/communication conductor or line 30 and 31. The control sensor or thermistor 28 generates a sensor control signal when a predetermined operating condition such as a predetermined temperature is sensed in the evaporator 14 that causes the air handler electronic system 24 to generate a compressor control signal fed over the air handler power/communication conductor or line 30 to stop or turn-off the compressor 10 as described more fully hereinafter. The compressor 10 is coupled to an external power source (not shown) by a power supply line or conductor 32.

As shown in FIG. 1, the control system comprises a condensate sensor 34 disposed to sense when condensate within the condensate drain pan 20 reaches a predetermined level and a control device generally indicated as 36 operatively coupled to the condensate sensor 34 by sensor signal conductors or lines 38 and 40 and to the control sensor or thermistor 26 by a control signal conductor 42 and to the air handler electronic system 24 of the air handler 14 by conductor or line or 44 to control the operation of the control sensor or thermistor 26 and, in turn, the compressor 10 as described more fully hereunder.

Figure 4:
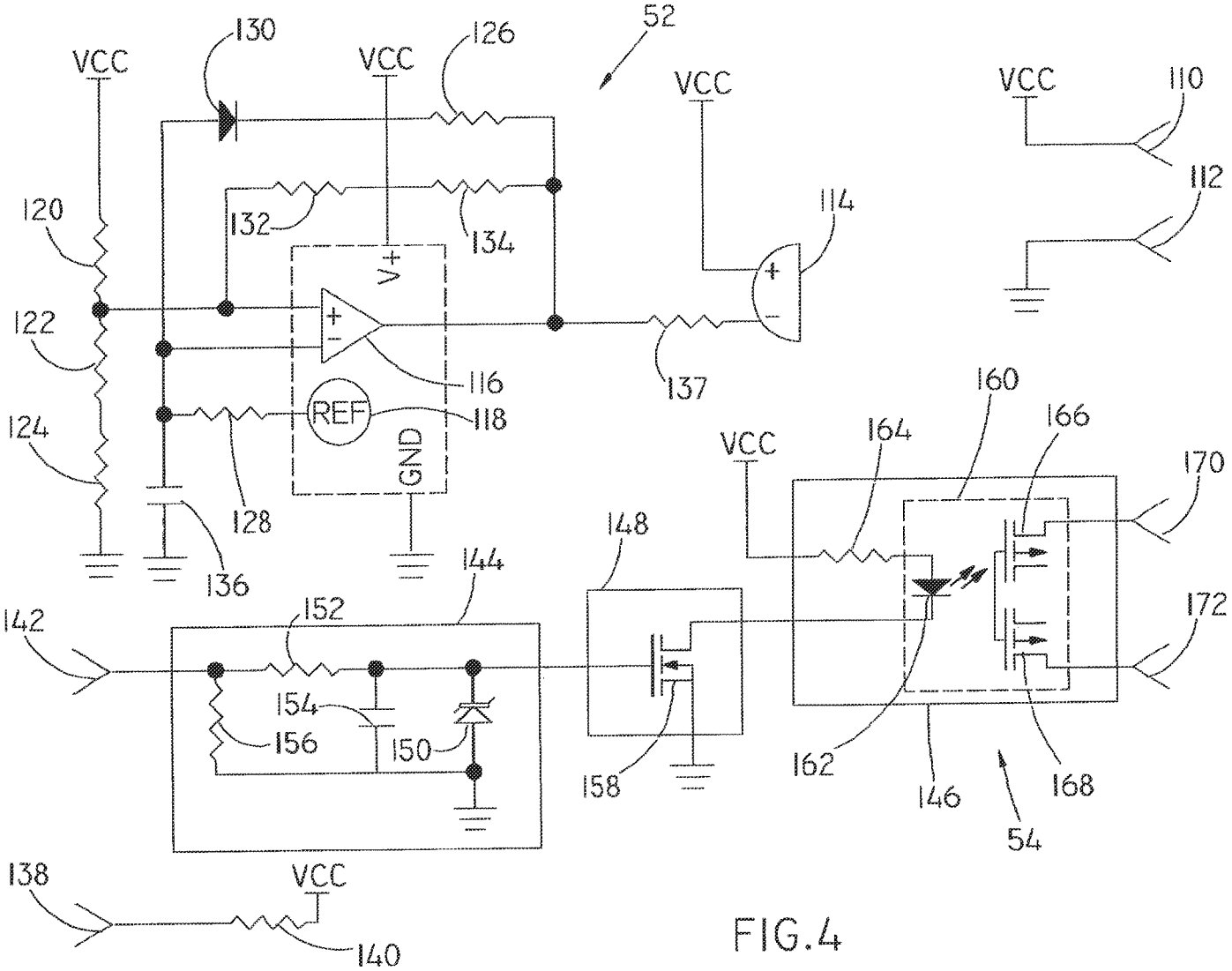
FIG. 4 is a circuit diagram or schematic of the control system of the present invention.

As shown in FIGS. 2 and 4, the condensate sensor 34 comprises a first condensate sensing probe 46 and a second condensate sensing probe 48 coupled or connected to the control device 36 that comprises a battery power source, low battery indicator or alarm and a solid state isolated control relay or switch generally indicated as 50, 114 and 54 respectively enclosed within a housing and a back plate generally indicated as 56 and 58 respectively.

Figure 3:
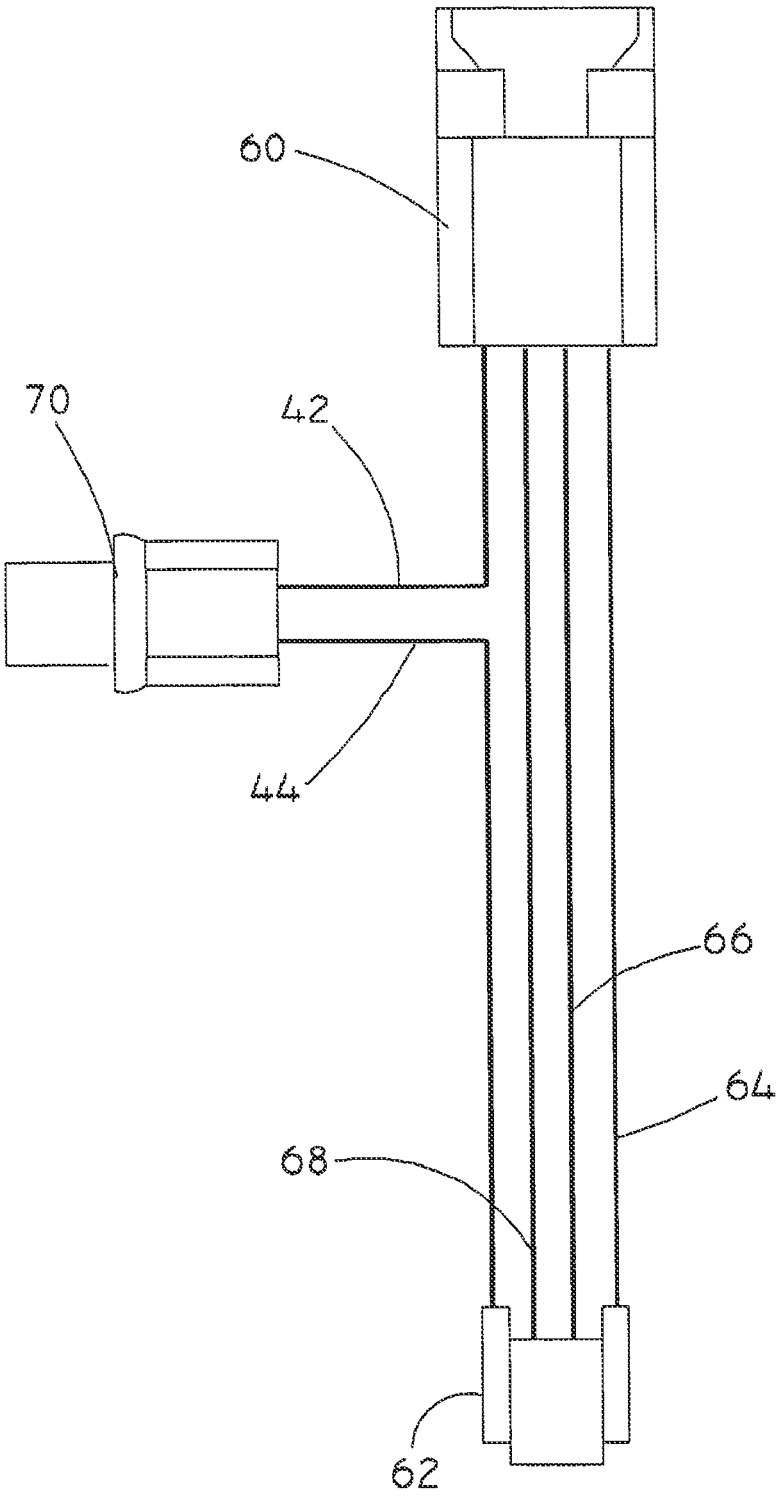
FIG. 3 is a detailed view of the coupling harness of the control system of the present invention.

FIG. 3 depicts a coupling harness comprising a control sensor interface connector 60 and an air handler electronics system interface connector 62 connected to control sensor or thermistor 26 and the air handler electronic system 24 by conductors 64, 66 and 68, and connected to a control device interface connector 70 coupled between the control sensor or thermistor 26 and the air handler electronics system 24 by the conductors 42 and 44 respectively to operatively integrate the control system 36 with an existing mini-split air conditioning system without compromising the integrity of the communication and control links 30 and 31.

FIG. 4 is a schematic diagram of the control system 36 comprising the battery power source 50, the low battery indicator/alarm 52 and the solid state control relay/switch 54.

The solid state relay/switch 54 is powered by the isolated external battery power source 50 connected between a positive voltage socket or connector 110 and a ground and negative voltage socket or connector 112.

The low battery indicator/alarm 52 comprises a buzzer or audible alarm 114 coupled to the output of a comparator 116 coupled to the voltage power source 50 and a fixed reference voltage 118 to generate a low battery indication when the voltage from the battery power source 50 reaches a minimum predetermined voltage such as 1.2 volts. The low battery indicator/alarm 50 further includes scaling resistors 120, 122 and 124, timing resistors 126 and 128 and timing diode 130, feedback resistors 132 and 134, capacitor 136, and resistor 137.

A positive voltage socket or connector 138 is coupled between the battery power source 50 through current limiting resistor 140 and the first condensate sensing probe 46 through the first sensor signal conductor or line 38 and a socket or connector 142 is coupled between the solid state relay/switch circuit described hereinafter and the second condensate sensing probe 48 through the second sensor signal conductor or line 40.

The solid state relay/switch circuit comprises an input stage generally indicated as 144 coupled to an output stage generally indicated as 146 by an intermediate control stage generally indicated as 148.

The input stage 144 comprises voltage limiting zener diode 150, resistor 152 and filter capacitor 154 combination and resistor 156 to hold the voltage low and configured to receive current through socket or connector 142 when the level of condensate within the condensate drain pan 20 is such that the tips of first condensate sensing probe 46 and the second condensate sensing probe 48 are submersed in the condensate completing the circuit causing current to flow through the input stage 144. The intermediate control stage 148 comprises a field effect transistor 158 coupled to the output of the input stage 144 such that when current flows through the input stage 144 the field effect transistor 158 is turned on.

The output stage 146 comprises a opto isolator or opto coupler 160 including a light emitting diode (LED) 162 coupled between positive voltage VCC through resistor 164 and field effect transistor 158 of intermediate control stage 148, and a pair of field effect transistors 166 and 168 coupled to the control sensor or thermistor 26 and the evaporator 14 through sockets or connectors 170 and 172, and control signal conductor or line 42 and control signal conductor or line 44 respectively such that when field effect transistor 158 of intermediate control stage 148 is conducting LED 162 of opto isolator or opto coupler 160 is energized driving the field transistors 166 and 168 causing the control sensor or thermistor 26 to generate a sensor control signal whereby the circuit through the air handler electronic system 24 to generate an "off" or compressor signal fed to the compressor 10 through the air handler power/communications conductors or lines 30 and 31 shutting down the compressor 10 when the condensate level reaches a predetermined level in the condensate drain pan 20 as sensed by the first condensate sensing probe 46 and the second condensate sensing probe 48 thus completing a circuit to actuate the control sensor or thermistor 26.

The condensate can be drained or pumped from the condensate drain pan 20 through the condensate drain conduit 22.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

The invention claimed is:

1. A method of providing alarm signals to a HVAC mini-split system having a thermistor, a condensate overflow sensor and a HVAC electronic control device, said system controlling a compressor, the method comprising:

engaging a single, unitary, removable, releasable, self-contained, alarm coupling harness with the HVAC mini-split system, the alarm coupling harness having at least first, second, and third ends, said first end having a first electrically-coupled connector electrically connecting with the thermistor, said second end having a second electrically-coupled connector electrically connecting with the condensate overflow sensor, and said third end having a third electrically-coupled connector electrically connecting with the HVAC electronic device at least one among the first and second interfaces directing a signal to the third connector when an alarm condition exists in the thermistor and/or condensate overflow sensor, respectively;

in response to a signal received from either the first or second connectors, the third connector notifying the HVAC electronic control device that an alarm condition exists; and stopping the operation of the compressor.

* * * * *